US006784858B2

(12) United States Patent
Awamoto

(10) Patent No.: US 6,784,858 B2
(45) Date of Patent: Aug. 31, 2004

(54) DRIVING METHOD AND DRIVING CIRCUIT OF PLASMA DISPLAY PANEL

(75) Inventor: Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 84 days.

(21) Appl. No.: 09/803,994

(22) Filed: Mar. 13, 2001

(65) Prior Publication Data

US 2002/0054001 A1 May 9, 2002

(30) Foreign Application Priority Data

Oct. 27, 2000 (JP) ..... 2000-328176

(51) Int. Cl.[7] ..... G09G 3/28
(52) U.S. Cl. ..... 345/60; 345/62; 345/63
(58) Field of Search ..... 345/60, 63, 62, 345/55, 68, 67, 89, 148; 315/169.4

(56) References Cited

U.S. PATENT DOCUMENTS 3,733,435 A * 5/1973 Chodil et al. ..... 348/797
5,510,678 A * 4/1996 Sakai et al. ..... 315/58
5,745,086 A 4/1998 Weber ..... 345/63
6,104,362 A * 8/2000 Kuriyama et al. ..... 345/63
6,151,001 A * 11/2000 Anderson et al. ..... 345/63
6,295,040 B1 * 9/2001 Nhan et al. ..... 345/60
6,323,596 B1 * 11/2001 Ito et al. ..... 315/169.3
6,337,673 B1 * 1/2002 Ide et al. ..... 345/60
6,340,867 B1 * 1/2002 Kang ..... 315/169.4
6,369,781 B2 * 4/2002 Hashimoto et al. ..... 345/60
6,483,250 B1 * 11/2002 Hashimoto et al. ..... 315/169.4
6,483,490 B1 * 11/2002 Lo ..... 345/60

* cited by examiner

*Primary Examiner*—Amare Mengistu
*Assistant Examiner*—Prabodh M. Dharia
(74) *Attorney, Agent, or Firm*—Staas & Halsey LLP

(57) ABSTRACT

A driving method as well as a circuit of a plasma display panel is provided in which a rate of increasing voltage at start of a discharge is reduced, a reset period is shortened, and an excessive discharge in the reset period is avoided. The plasma display panel 1 comprises plural cells each of which emits light when a discharge is generated between a pair of display electrodes X and Y. Charge quantities of all cells are equalized in a reset period. In a bias period of the reset period, a current is supplied from a constant current circuit 93 to cells so that an increasing voltage is applied to the pair of display electrodes, while a capacitance element C3 is connected in parallel with a cell, so that an output current Ic of the constant current circuit 93 is distributed to the capacitance element C3 and the cell.

22 Claims, 13 Drawing Sheets

FIG. 16 *PRIOR ART*
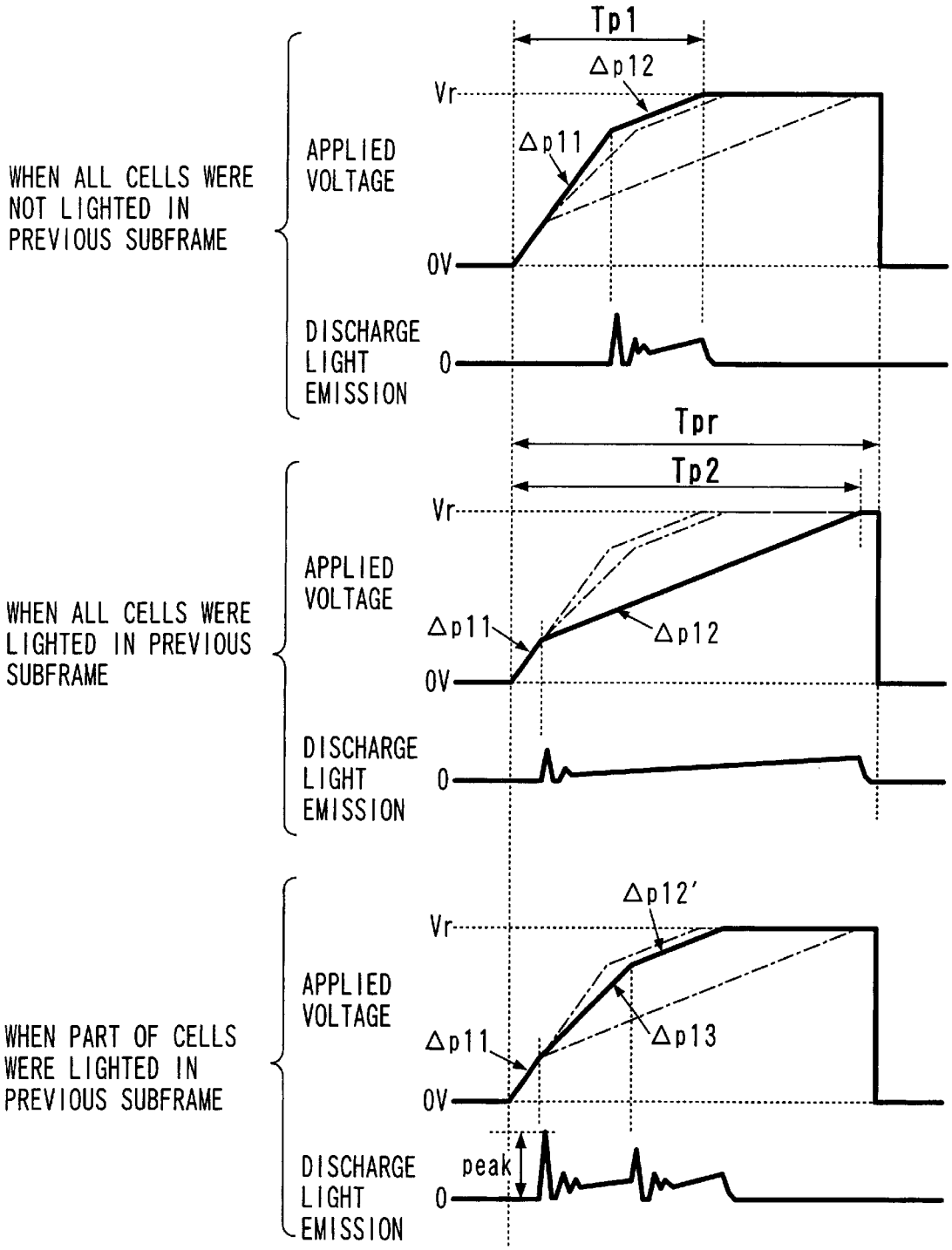

DRIVING METHOD AND DRIVING CIRCUIT OF PLASMA DISPLAY PANEL

BACKGROUND OF THE INVENTION

1. Field of the Invention

The present invention relates to a driving method and a driving circuit of a plasma display panel (PDP).

Development of a PDP having a large screen and a high resolution is proceeding. When the number of cells constituting a screen increases, a misdischarge can be generated easily. In an AC type PDP, equalization of charge of all cells is performed before addressing for forming a charge distribution corresponding to display data, and quality of the equalization affects success or failure of the addressing. Therefore, a driving method that enables high accuracy equalization in a short time is desired.

2. Description of the prior art

AC type PDP utilizes a memory function of a dielectric layer that covers display electrodes. Namely, addressing is performed for controlling charge quantity of a cell in accordance with display data before applying a sustaining voltage Vs having alternating polarity to a pair of display electrodes. The sustaining voltage Vs satisfies the following inequality.

$$Vf-Vw<Vs<Vf$$

Here, Vf denotes a discharge starting voltage, and Vw denotes a wall voltage between electrodes. The application of the sustaining voltage Vs causes a display discharge only in cells having wall charge when a cell voltage (an effective voltage of the voltage applied to the electrode plus the wall voltage) exceeds the discharge starting voltage Vf. A light emission caused by a display discharge is referred to as "lighting". When shortening the application period of the sustaining voltage Vs, the light emission looks continuous.

Since a cell of a PDP is a binary light emission element, a half tone is reproduced by setting the number of discharges in one frame for each cell in accordance with a gradation level. A color display is a type of the gradation display, and a display color is determined by a combination of luminance values of three primary colors. A gradation display utilizes a method of constituting one frame of plural subframes weight by the luminance and setting the total number of discharges by combining lighting and non-lighting of each subframe. Furthermore, in the case of an interlace display, each of plural fields of a frame is made of plural subfields, and lighting control is performed by a unit of subfield. However, a content of the lighting control is the same as that of a progressive display.

A reset period (addressing preparation period) for initialization of equalizing an electrification state of the entire screen before the addressing is assigned to a subframe along with an address period for addressing and a display period (also referred to as a sustain period) for generating display discharges the number of times corresponding the weight of the luminance. At the end of the display period, there are cells having relatively much remaining wall charge and cells having little remaining wall charge. Therefore, initialization is performed as a preparation process for increasing reliability of addressing.

U.S. Pat. No. 5,745,086 discloses an initialization step in which a first and a second ramp voltages are applied to cells successively. The application of the ramp voltage having a mild gradient prevents drop of contrast by reducing light emission quantity in the initialization and enables setting the wall voltage to any desired value despite of a variation of the cell structure, due to the microdischarge property that will be explained below.

When applying a ramp voltage having increasing amplitude to a cell having an appropriate quantity of wall charge, plural microdischarge are generated during the applied ramp voltage increases under the condition of the mild gradient of the ramp voltage. If the gradient is further reduced, the discharge intensity is decreased, and the discharge period is shortened to become a continuous discharge form. In the following explanation, a periodic discharge and a continuous discharge are generally referred to as a "microdischarge". In a microdischarge, a wall voltage can be set only by a peak voltage of a ramp waveform. It is because that the generation of the microdischarge keeps the cell voltage to a vicinity of the voltage Vt even if a cell voltage Vc (i.e., a wall voltage Vw plus an applied voltage Vi) that is applied to a discharge space exceeds a discharge starting threshold level (hereinafter denoted by Vt) due to the increase of the ramp voltage. The microdischarge drops the wall voltage to an extent corresponding to the increase of the ramp voltage. The final value of the ramp voltage is denoted by Vr, and the wall voltage at the time point of the final value Vr of the ramp voltage is denoted by Vw. Then, since the cell voltage Vc is maintained at Vt, the following relationship holds.

$$Vc=Vr+Vw=Vt$$

Therefore, $$Vw=-(Vr-Vt)$$

Since Vt is a constant value determined by electric characteristics of a cell, the wall voltage can be set to any desired vale by setting the final value Vr of the ramp voltage. More specifically, even if there is a minute difference of Vt between cells, the relative difference between Vt and Vw can be equalized for all cells.

In the initialization that generates the microdischarge, the application of the first ramp voltage causes forming of an appropriate quantity of wall charge between the display electrodes. After that, the second ramp voltage is applied so that the wall voltage between the display electrodes approaches the desired value. For example, in the initialization for writing format of addressing, the wall charge is eliminated so that the wall voltage becomes zero. The amplitude of the first ramp voltage is set so that a microdischarge is always generated by the second ramp voltage.

Conventionally, a constant current circuit having a combination of a field effect transistor (FET) and a resister is used as means for applying a ramp voltage. For example, a ramp voltage of positive polarity is applied by connecting the drain of the FET to a display electrode of a cell, and the source of the FET is connected to a power source via the resistor. The gate of the FET is biased to a predetermined potential so as to turn on the FET. Then, a current flows from the power source to the display electrode. The current is limited by the resister, and a predetermined current is supplied to the cell. A cell without a discharge is a capacitive load to a power source. Therefore, the supply of the predetermined current increases the applied voltage between the display electrodes at substantially a constant rate.

Furthermore, instead of a ramp voltage, an obtuse waveform voltage having amplitude increasing exponentially can be applied for generating a microdischarge. However, in an obtuse waveform, the increasing rate of the voltage in the latter portion is so small that the time until the amplitude reaches a predetermined value becomes long. If the increasing rate of the voltage in the latter portion is increased for shortening an application time, the increasing rate of the voltage in the front portion becomes so large that a pulse discharge in which the wall charge changes rapidly can be generated easily instead of the microdischarge. Application of a ramp voltage can shorten the reset period compared with application of an obtuse waveform voltage.

FIG. 16 is a diagram showing a transition of a driving voltage in the conventional method.

Before a microdischarge is generated, a capacitance between the display electrodes is charged by a whole current supplied from the constant current circuit. When a microdischarge starts, a part of the supplied current becomes a discharge current, so that the current for charging the capacitance between the display electrodes decreases. Therefore, the increasing rate of the applied voltage between the display electrodes, i.e., the gradient of the ramp waveform is not constant but alters depending on whether discharge exists or not. In the initialization as a preparation of addressing in a certain subframe, the gradient of the ramp waveform alters from Δp11 to Δp12 that is smaller than Δp11 as a discharge starts if all cells were not lighted in the previous subframe. In this case, since there is little wall charge in the cell when the initialization starts, a discharge starts at the time point when the applied voltage approaches the final value Vr. Therefore, the time Tp1 until the applied voltage reaches the final value Vr is relatively short. In contrast, if all cells were lighted in the previous subframe, a discharge starts when the applied voltage is still low since the cell has a remaining wall charge at the time point of starting the initialization. Therefore, the time Tp2 until the applied voltage reaches the final value Vr is relatively long. The pulse width (application period) Tpr of the applied voltage pulse is set in accordance with the time Tp2. In the conventional method, since the gradient of the ramp waveform alters substantially due to a discharge, the pulse width Tpr cannot be shortened so that a long time is necessary for the initialization. The reset period is preferably as short as possible for securing a time that can be assigned to addressing or sustaining.

Moreover, if a few cells were lighted in the previous subframe, a discharge starts in a few cells when the applied voltage is still low. The gradient of the ramp waveform alters from Δp11 to Δp13 that is smaller than Δp11. After that, when the applied voltage approaches the final value Vr, a discharge starts in the remaining many cells, and the gradient of the ramp waveform alters from Δp13 to Δp12'that is smaller than Δp13. In this case, when a discharge occurs in a few cells, an excessive current is supplied so that a pulse discharge occurs easily instead of a microdischarge. A current is distributed when a discharge occurs in many cells simultaneously. In this case, however, the current is concentrated in a few cells. In order to prevent the pulse discharge, the gradient Δp11 of the ramp waveform at non-discharge is required to be sufficiently small. However, if the gradient Δp11 is decreased, the pulse width Tpr is elongated.

SUMMARY OF THE INVENTION

An object of the present invention is to reduce a rate of increase of the voltage so as to shorten a reset period. Another object is to prevent an excessive discharge in the reset period so that a reliability of initialization is increased.

According to the present invention, a capacitance element is connected in parallel with a cell in a bias period for applying an increasing voltage within the reset period, and a current is supplied from a constant current circuit to the capacitance element and the cell. When a discharge is generated in a cell, a current of charging an interelectrode capacitance of the cell and the capacitance element decreases by the quantity of the discharge current. The decreasing quantity is distributed to the cell and the capacitance element. Therefore, the decreasing quantity of the current charging the interelectrode capacitance is less than that in the case where no capacitance element is connected. Namely, a rate of increase of the applied voltage becomes small so that the time until the applied voltage reaches the final value is shortened.

In addition, according to the present invention, the supply of a current from the constant current circuit to the cell in the reset period is performed intermittently in accordance with a quantity of a display load in the display period. Because of the intermittent supply of the current, the applied voltage waveform becomes a step waveform. The intermittent supply in accordance with a display load can enlarge an increasing rate of the voltage as much as possible when a discharge is generated in many cells. Thus, the time necessary for initialization can be shortened, and an excessive discharge can be avoided when a discharge is generated in a few cells.

BRIEF DESCRIPTION OF THE DRAWINGS

FIG. 16 is a diagram showing a transition of a driving voltage in the conventional method.

DESCRIPTION OF THE PREFERRED EMBODIMENTS

Hereinafter, the present invention will be explained more in detail with reference to embodiments and drawings.

Figure 1:
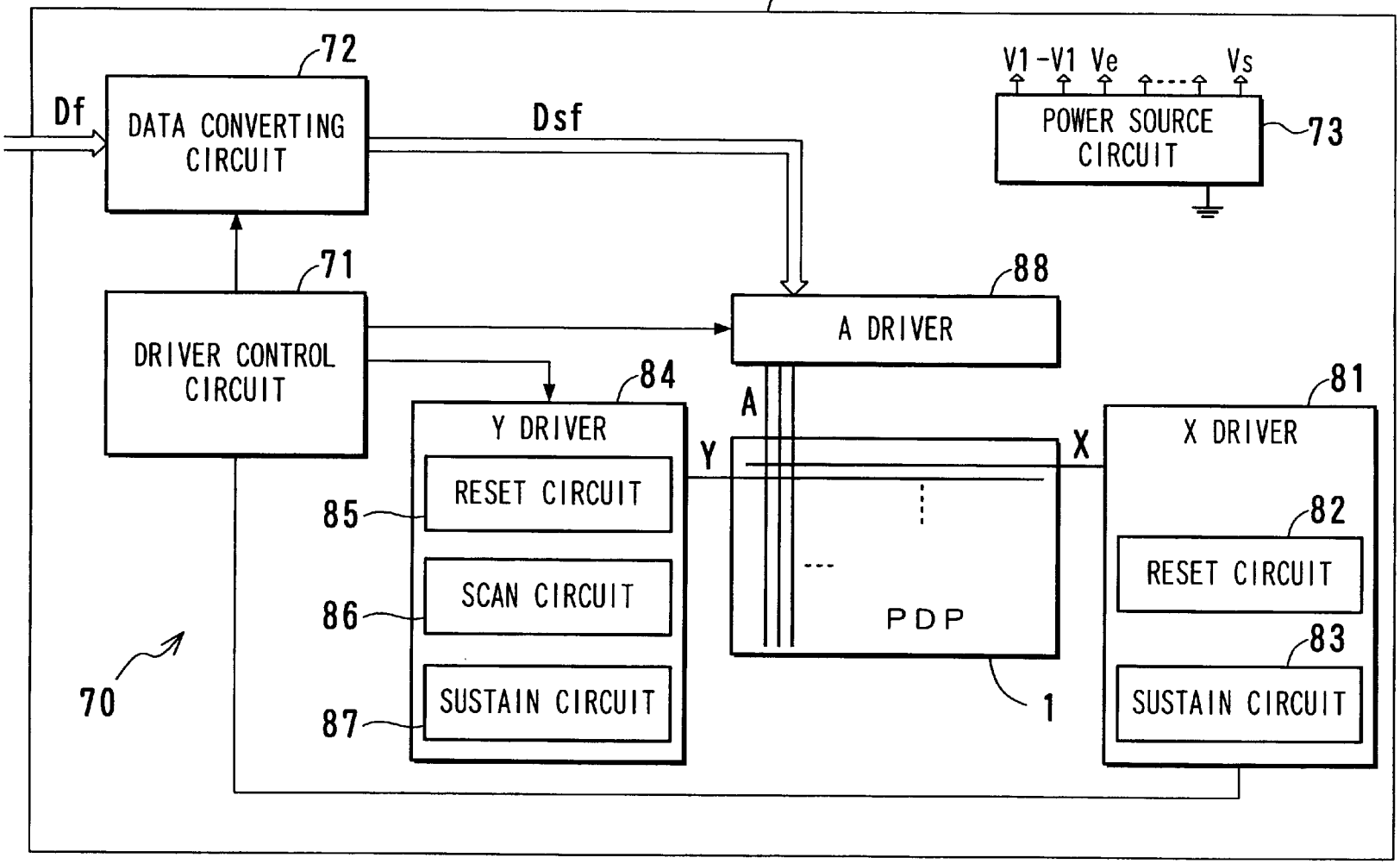
FIG. 1 is a block diagram of a display device according to the present invention.

FIG. 1 is a block diagram of a display device according to the present invention. The display device 100 comprises a surface discharge type PDP 1 having a display surface made of m×n cells, and a drive unit 70 for selectively lighting cells arranged in a matrix. The display device 100 is used for a wall-hung TV set or a monitor display of a computer system.

PDP 1 includes display electrodes X and Y that form electrode pairs as being arranged in parallel for generating display discharge and address electrodes A arranged to cross the display electrodes X and Y. The display electrodes X and Y extend in the row direction (horizontal direction) of the screen, and the address electrodes extend in the column direction (vertical direction).

The drive unit 70 includes a driver control circuit 71, a data converting circuit 72, a power source circuit 73, an X driver 81, a Y driver 84, and an A driver 88. The drive unit 70 is supplied with frame data Df indicating luminance levels of red, green and blue colors from external equipment such as a TV tuner or a computer along with various synchronizing signals. The frame data Df are memorized temporarily in a frame memory of the data converting circuit 72. The data converting circuit 72 converts the frame data Df into subframe data Dsf for gradation display and sends the data to the A driver 88. The subframe data Dsf are a set of display data containing one bit per cell. The value of each bit indicates whether a cell of the corresponding subframe is lighted or not, more specifically, whether an address discharge is required or not. The X driver 81 includes a reset circuit 82 for applying an initializing pulse to the display electrode X and a sustain circuit 83 for applying a sustaining pulse to the display electrode X. The Y driver 84 includes a reset circuit 85 for applying an initializing pulse to the display electrode Y, a scan circuit 86 for applying a scanning pulse to the display electrode Y in the addressing, and a sustain circuit 87 for applying a sustaining pulse to the display electrode Y. A driver 88 applies an address pulse to the address electrode A designated by the subframe data Dsf. An application of pulse means to bias an electrode to a predetermined potential temporarily.

The driver control circuit 71 controls application of a pulse and transmission of the subframe data Dsf. The power source circuit 73 supplies a driving power to necessary portions via wiring pattern (not shown).

Figure 2:
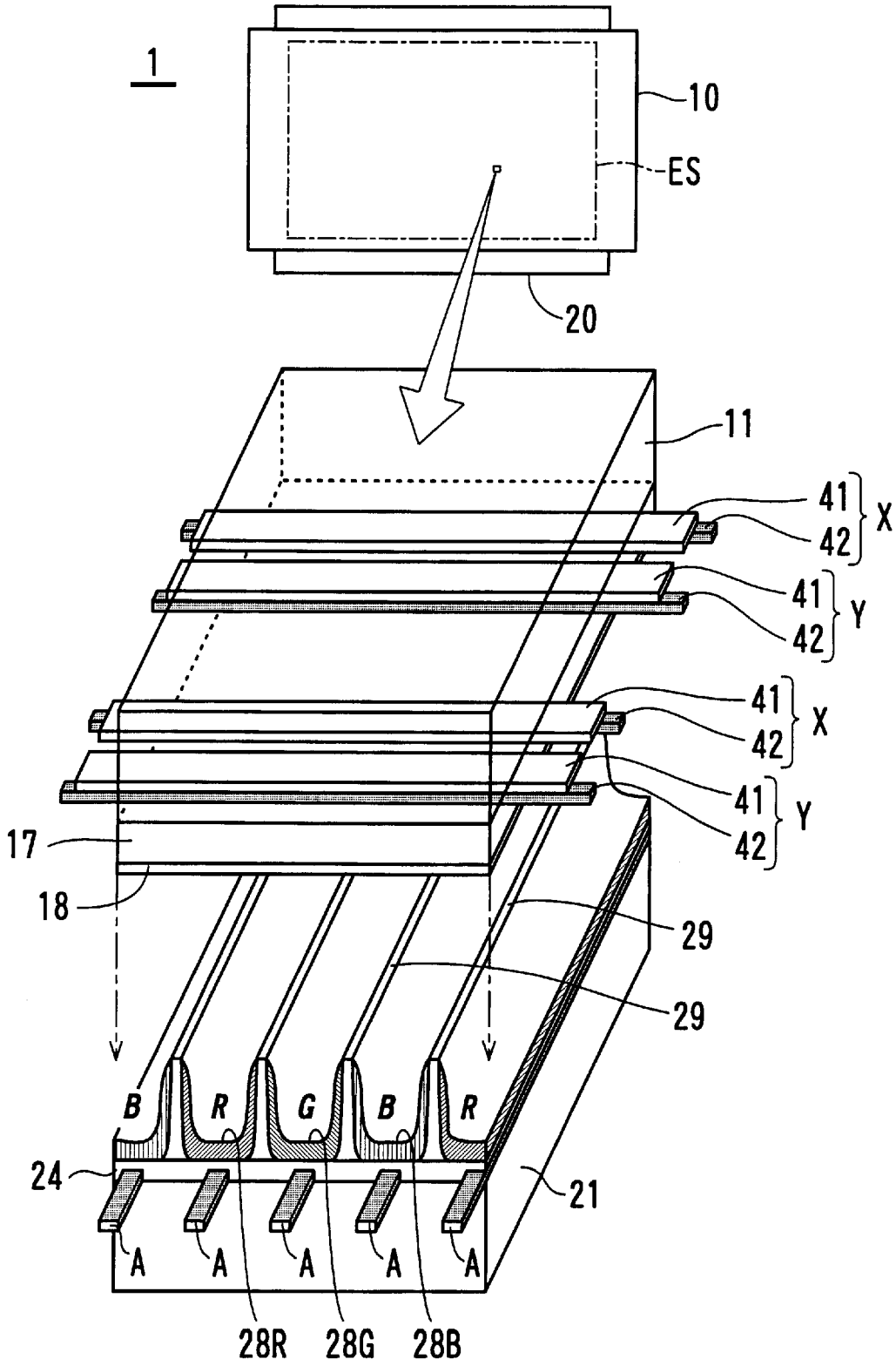
FIG. 2 is a diagram showing an example of a cell structure of a PDP.

FIG. 2 is a diagram showing an example of a cell structure of a PDP.

PDP 1 includes a pair of substrate structures (each structure has a substrate on which cell elements are arranged) 10 and 20. On the inner surface of the front glass substrate 11, a pair of display electrodes X and Y is arranged for each row of a display surface ES having n rows and m columns. Each of the display electrodes X and Y includes a transparent conductive film 41 forming a surface discharge gap and a metal film 42 overlaid on the edge portion of the transparent conductive film 41. The display electrodes X and Y each are covered with a dielectric layer 17 and a protection film 18. On the inner surface of the rear glass substrate 21, an address electrode A is arranged for each column. Each of the address electrodes A is covered with a dielectric layer 24. On the dielectric layer 24, a partition 29 for dividing a discharge space into columns. The partition pattern is a stripe pattern. The surface of the dielectric layer 24 and the side face of the partition 29 are covered with fluorescent material layers 28R, 28G and 28B for color display, which are excited locally by ultraviolet rays generated by a discharge gas and emit light. Italic letters (R, G and B) in FIG. 2 indicate light emission colors of the fluorescent material layers. The color arrangement has a repeating pattern of red, green and blue colors in which cells in a column have the same color.

Hereinafter, a driving method of the PDP 1 of the display device 100 will be explained.

Figure 3:
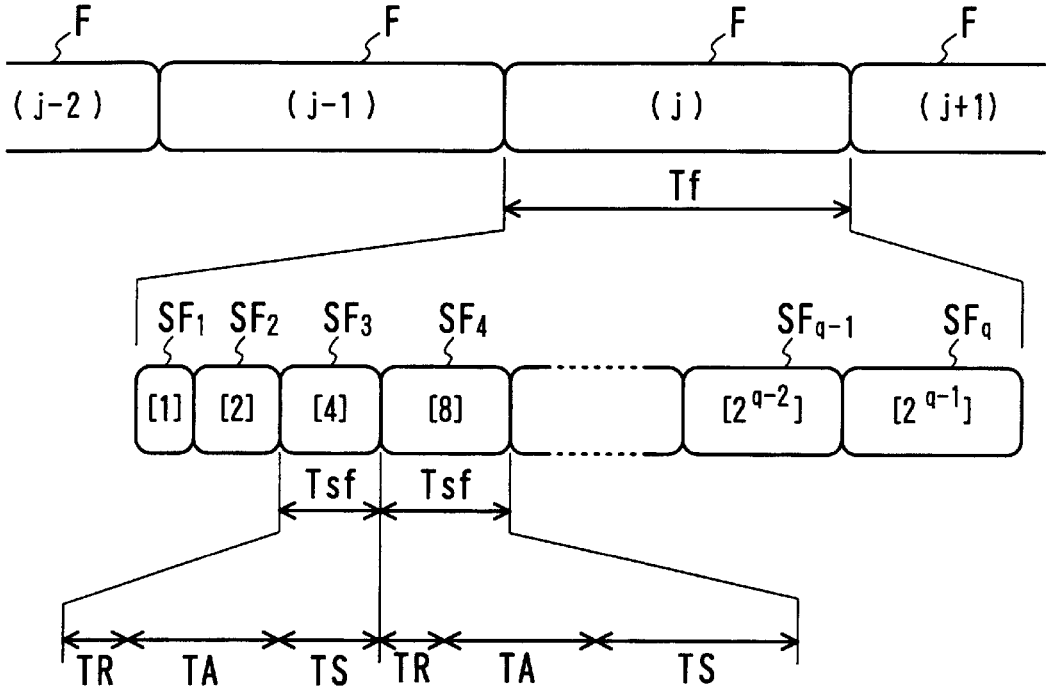
FIG. 3 is a schematic diagram of a frame division.

FIG. 3 is a schematic diagram of a frame division. The display of PDP 1 reproduces a color utilizing a binary lighting control. Therefore, a frame F of an input image is divided into a predetermined number q of subframes SF. Namely, each frame F is replaced with a set of q subframes SF. The subframes SF are given weights of $2^0, 2^1, 2^2, \ldots, 2^{q-1}$ to set the number of display discharges of each subframe SF. By combining lighting and non-lighting of each subframe, N $(=1+2^1+2^2+\ldots+2^{q-1})$ steps of luminance levels can be set for each of red, green and blue colors. In FIG. 3, the subframes are arranged in the order of weight; however, another order is possible. The frame period Tf that is a frame transferring period is divided into q subframe periods Tsf in accordance with the frame structure, and a subframe period Tsf is assigned to each subframe SF. In addition, the subframe period Tsf is divided into a reset period TR for initialization, an address period TA for addressing, and a display period TS for lighting. Lengths of the reset period TR and the address period TA are constant regardless of a weight, while a length of the display period TS is longer for a larger weight. Therefore, a length of the subframe period Tsf is also longer if a weight of the corresponding subframe SF is larger.

Figure 4:
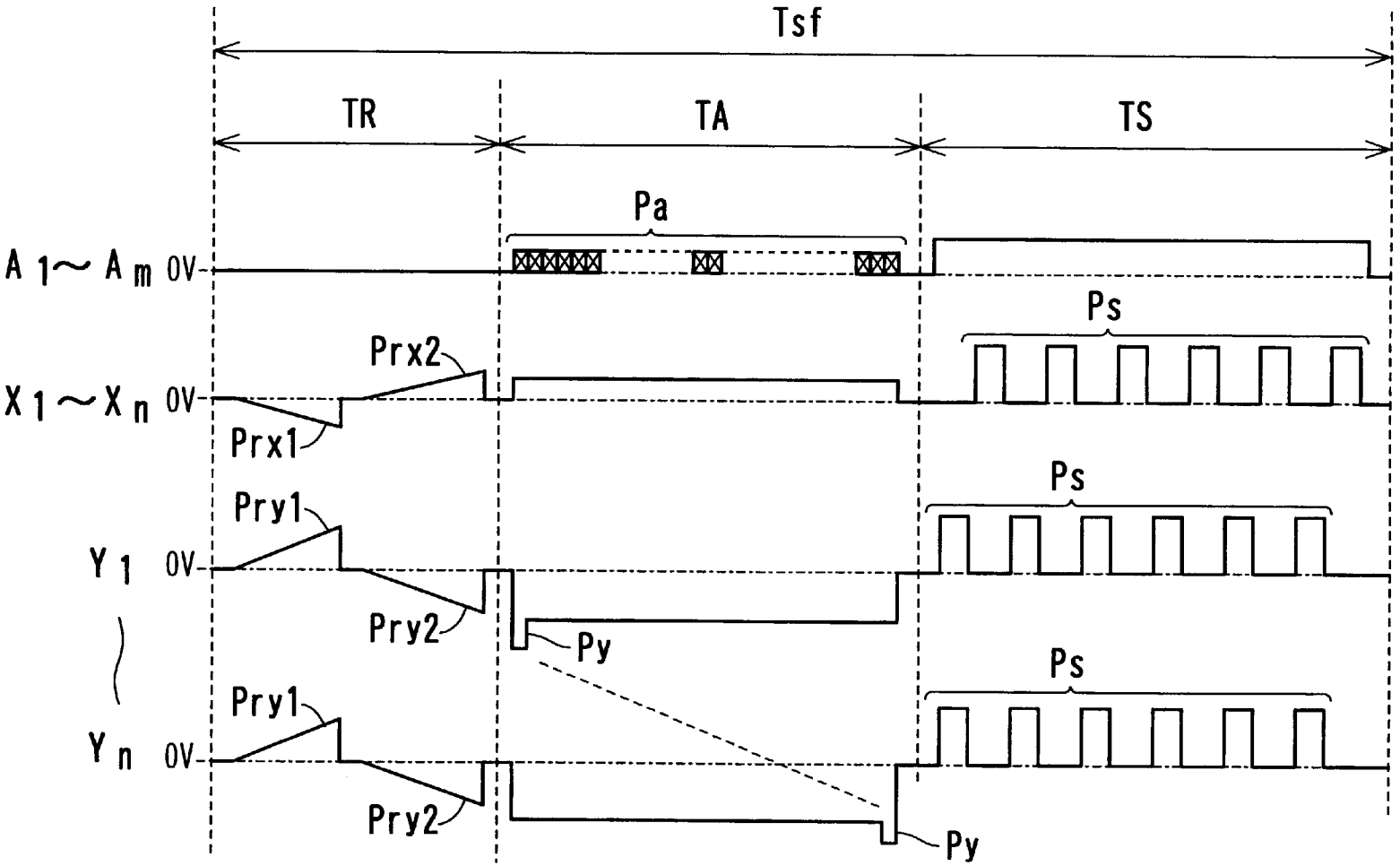
FIG. 4 is a diagram of voltage waveforms showing a scheme of driving sequence.

FIG. 4 is a diagram of voltage waveforms showing a scheme of driving sequence. In FIG. 4, suffix numbers (1, n) of the display electrodes X and Y indicate arrangement orders of the corresponding rows, and suffix numbers (1, m) of the address electrodes A indicate arrangement orders of the corresponding columns. Furthermore, the waveforms in FIG. 4 are shown by way of an example, and the amplitude, the polarity and the timing can be changed variously.

The order of the reset period TR, the address period TA and the display period TS is the same in q subframes SF, and the driving sequence is repeated every subframe. In the reset period TR of each subframe SF, a pulse Prx1 having a negative polarity and a pulse Prx2 having a positive polarity are applied to all display electrodes X sequentially, while a pulse Pry1 having a positive polarity and a pulse Pry2 having a negative polarity to all display electrodes Y sequentially. The pulses Prx1, Prx2, Pry1 and Pry2 are ramp waveform pulses whose amplitudes increase at a rate generating a microdischarge. The first applied pulses Prx1 and Pry1 are applied for generating an appropriate wall voltage having the same polarity in all cells regardless of lighted or non-lighted in the previous subframe. When applying pulses Prx2 and Pry2 to cells having an appropriate wall charge, the wall voltage can be adjusted to a value corresponding to the difference between a discharge starting voltage and a pulse amplitude in accordance with the values of pulses Prx2 and Pry2. The initialization (equalization of charge) in this example makes the wall charge of all cells constant quantity (zero or a predetermined quantity) and makes the wall voltage constant value. Though the pulse can be applied to one of the display electrodes X and Y for initialization, the method shown in FIG. 4 applies pulses having opposite polarities to display electrodes X and Y, respectively. Thus, a withstand voltage of the driver circuit element can be lowered. The driving voltage applied to the cell is a composed voltage to which an amplitude of the pulse applied to the display electrodes X and Y is added.

In the address period TA, a wall charge necessary for sustaining is formed only in cells to be lighted. All the display electrodes X and Y are biased to a predetermined potential, while a scanning pulse Py having a negative polarity is applied to one display electrode Y corresponding to the selected row in each row selection period (scanning time of one row). Simultaneously with this row selection, an address pulse Pa is applied only to an address electrode A corresponding to the selected cell to generate an address discharge. Namely, potentials of the address electrodes $A_1$–$A_m$ are controlled in binary manner in accordance with the subframe data Dsf of m columns of the selected row. In the selected cell, a discharge is generated between the display electrode Y and the address electrode A, which causes a surface discharge between the display electrodes. This sequence of discharges is an address discharge.

In a sustaining period TS, a sustaining pulse Ps having a predetermined polarity (positive polarity in this example) is applied to all display electrodes Y. After that, the sustaining pulse Ps is applied to the display electrode X and the display electrode Y alternately. An amplitude of the sustaining pulse Ps is a sustaining voltage (Vs). The application of the sustaining pulse Ps generates a surface discharge in a cell having a predetermined quantity of remaining wall charge. The number of applying the sustaining pulse Ps corresponds to the weight of the subframe as mentioned above. Furthermore, the address electrode A is biased to the same polarity as the sustaining pulse Ps so as to prevent an undesired discharge in the sustain period TS.

Among the above-mentioned driving sequence, the application of the first pulse in the reset period TR is the most important for the present invention. Hereinafter, a structure and an operation of the reset circuit 85 of the Y driver 84 that is means for applying the pulse Pry1 will be explained. The structure of the reset circuit 82 of the X driver 81 that is means for applying a pulse Prx1 is basically the same as the reset circuit 85 except for the difference of the polarity.

[First Embodiment]

Figure 5:
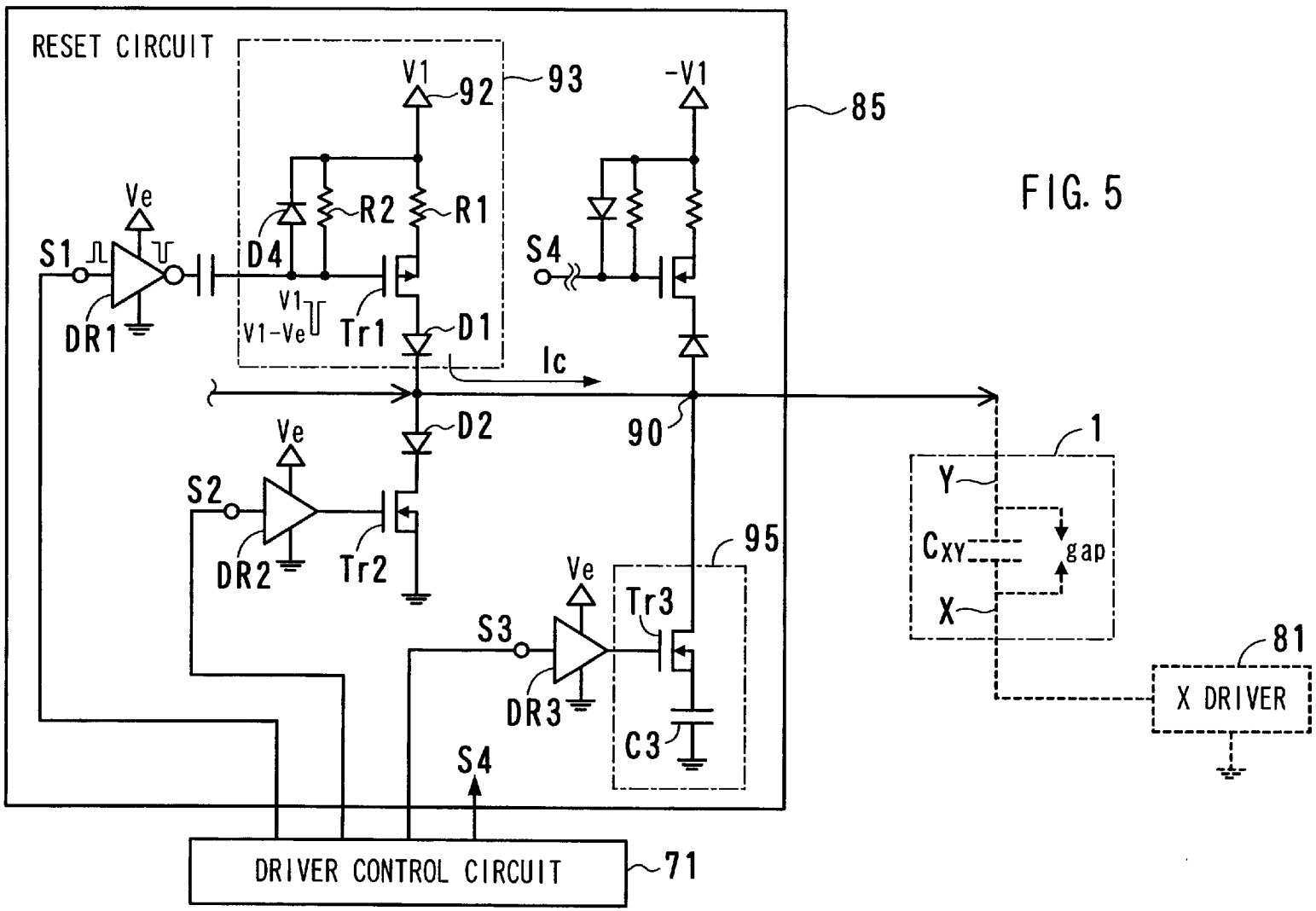
FIG. 5 is a schematic view of the reset circuit according to a first embodiment.

FIG. 5 is a schematic view of the reset circuit according to a first embodiment.

The reset circuit 85 includes a constant current circuit 93 for applying a ramp waveform pulse having a positive polarity, an N-channel field effect transistor (FET) Tr2 for controlling a current path between the display electrode Y and the ground line, an auxiliary charging circuit 95 that is unique to the present invention, and a current sink circuit for applying a ramp waveform pulse having a negative polarity. The constant current circuit 93 includes a power source (a bias potential line) 92 of a potential V1, a P-channel field effect transistor Tr1 for making and breaking a current path between an output terminal 90 connected to the display electrode Y and the power source 92, a current limiting resistor R1 inserted in a path between the power source 92 and the source of the field effect transistor Tr1, a bias resistor R2 connecting the power source 92 to the gate of the field effect transistor Tr1, a diode D4 connected in parallel with the bias resistor R2, and a diode D1 inserted in a path between the drain of the field effect transistor Tr1 and the output terminal 90. In addition, the auxiliary charging circuit 95 includes a capacitor C3 connected to the ground line at an end and an N-channel field effect transistor Tr3 for controlling a current path between the other end of the capacitor C3 and the output terminal 90. The reset circuit 85 includes gate drivers DR1, DR2 and DR3 for controlling the field effect transistors Tr1, Tr2 and Tr3. Gate signals S1, S2, S3 and S4 are supplied from the driver control circuit 71 to the gate drivers DR1, DR2 and DR3 and the current sink circuit. Furthermore, the output terminal 90 is also connected to the scan circuit 86 and the sustain circuit 87, so diodes D1 and D2 for preventing reverse current are provided between the output terminal 90 and each of the transistors Tr1 and Tr2.

Figure 6:
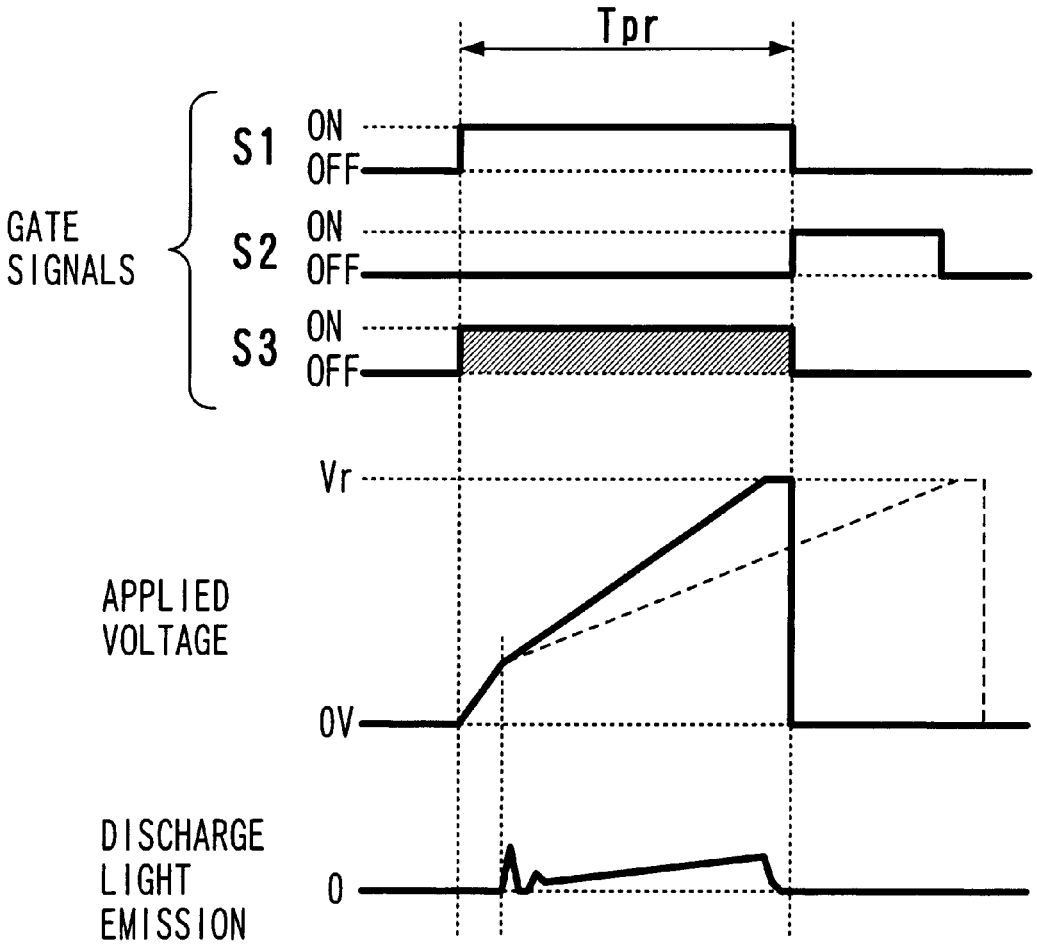
FIG. 6 is a diagram of waveforms showing a first example of the driving method according to the first embodiment.

FIG. 6 is a diagram of waveforms showing a first example of the driving method according to the first embodiment. Referring to FIG. 6 and FIG. 5, an operation of the circuit for applying the pulse Pry1 will be explained. Here, it is supposed that a capacitive load Cxy is connected to the output terminal 90 via the display electrode Y. The capacitive load Cxy has a capacitance that is a sum of capacitance values between display electrodes of cells to be driven (i.e., the PDP 1).

First, a fundamental operation will be explained. The gate driver DR1 outputs a pulse having an amplitude Ve obtained by shaping the gate signal S1. This output is transmitted to the gate of the transistor Tr1 through a coupling capacitor. The gate of the transistor Tr1 is supplied with a control pulse having the amplitude Ve whose pulse base is the potential V1, so that the gate potential becomes V1−Ve. Since the amplitude Ve is set to a value larger than a threshold level Vth of a voltage between the gate and the source of the transistor Tr1 (Ve>Vth), the transistor Tr1 is turned on. When the transistor Tr1 is turned on, a current Ic flows from the power source 92 to the capacitive load Cxy. In this state, a voltage drop occurs in the current limiting resistor R1, and a source potential of the transistor Tr1 becomes V1−Ve+Vth (i.e., the gate potential plus Vth). When the transistor Tr1 is turned on, the voltage Vg between the power source 92 and the gate is fixed. In this state, a voltage between the gate and the source alters in accordance with the change of the voltage of the current limiting resistor R1, while the current Ic is maintained at a constant value (Ve−Vth)/R1). Therefore, the potential of the display electrode Y increases at a predetermined rate. This rate is determined by a resistance of the current limiting resistor R1 and the voltage Ve, i.e., dV/dt=((Ve−Vth)/R1)/Cxy. When the transistor Tr1 is turned off, and the transistor Tr2 is turned on, the charge of the capacitive load Cxy is discharged to the ground line through the diode D2 and the transistor Tr2. Thus, the output voltage goes back to zero (ground potential). In this way, by turning on the transistor Tr1 once, a ramp waveform voltage is applied to a pair of display electrodes.

Next, an operation unique to the present invention will be explained. In the example of FIG. 6, the transistor Tr3 of the auxiliary charging circuit 95 is turned on during the entire period Tpr for maintaining the transistor Tr1 turned on, so that the capacitor C3 is connected to the output terminal 90. Thus, the current Ic is distributed to the capacitive load Cxy and the capacitor C3, and the capacitive load Cxy is charged by a part of the current Ic. When a discharge is generated in a cell while being charged, the charging current of the capacitive load Cxy and the capacitor C3 is reduced by the quantity corresponding to the discharge current. The reduced quantity is distributed to the parallel-connected capacitive load Cxy and the capacitor C3. Therefore, the reduced quantity of the charging current of the capacitive load Cxy becomes smaller than that in the case where the capacitor C3 is not connected. Namely, the rate of increase of the applied voltage is reduced. Therefore, if the current Ic is set so that the gradient of the ramp waveform before a discharge is generated is the same as that in the conventional method, the gradient after a start of discharge becomes larger than that in the conventional method that is shown by a broken line in FIG. 6. Thus, a time until the applied voltage reaches the final value becomes shorter than the conventional method.

Figure 7A:
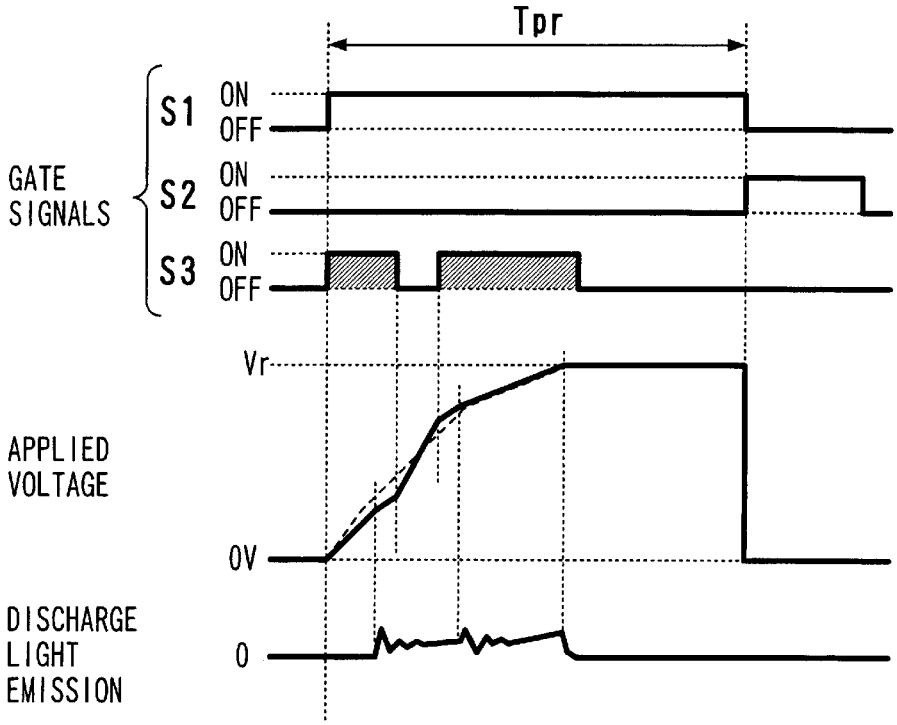
FIGS. 7A and 7B are diagrams of waveforms showing a second example of the driving method according to the first embodiment.
Figure 7B:
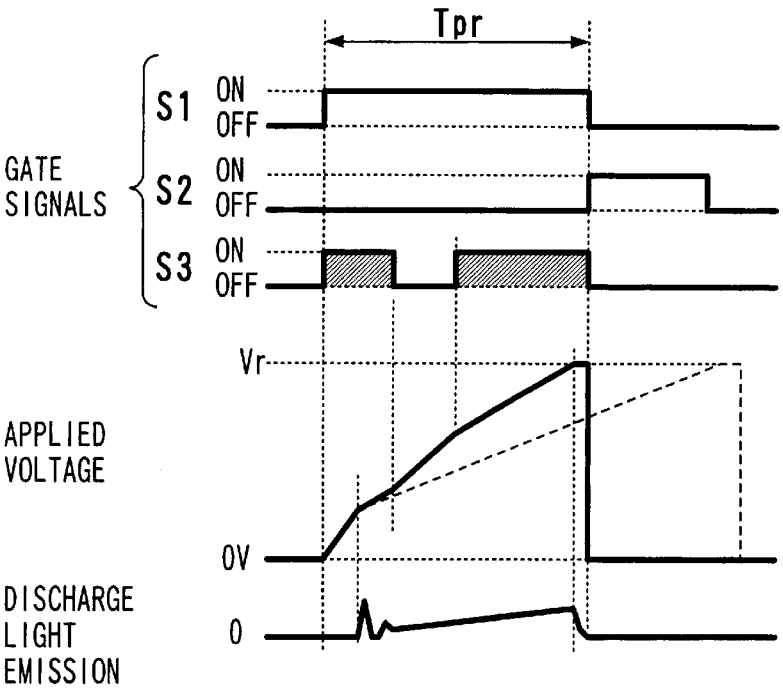

FIGS. 7A and 7B are diagrams of waveforms showing a second example of the driving method according to the first embodiment.

In this example shown in FIGS. 7A and 7B, the capacitor C3 is connected to the output terminal 90 intermittently during the period Tpr for maintaining the transistor Tr1 turned on. For example, the capacitor C3 is connected to the output terminal 90 only at the time when a discharge begins in the cell that was lighted in the previous subframe and at the time when a discharge begins in the cell that was not lighted in the previous subframe. Namely, the gradient of the waveform at the discharge starting time is set smaller than in the other period so that an excessive discharge is avoided. Also in the second example, the current Ic can be set so that the gradient of the ramp waveform before a discharge is generated is the same as that in the conventional method as shown in FIG. 7B. Thus, the time until the applied voltage reaches the final value can be shorter than that in the conventional method.

[Second Embodiment]

The applied voltage that generates a discharge in a cell lighted in the previous subframe is different from that in a cell not lighted in the previous subframe. However, an approximate range of the applied voltage is determined. In addition, if a ratio of the lighted cells and non-lighted cells, i.e., the display load in the previous subframe is known, the quantity of the discharge current at any time point can be determined. The driving method of the second embodiment optimizes the ramp waveform in accordance with the measurement result of the display load.

Figure 8:
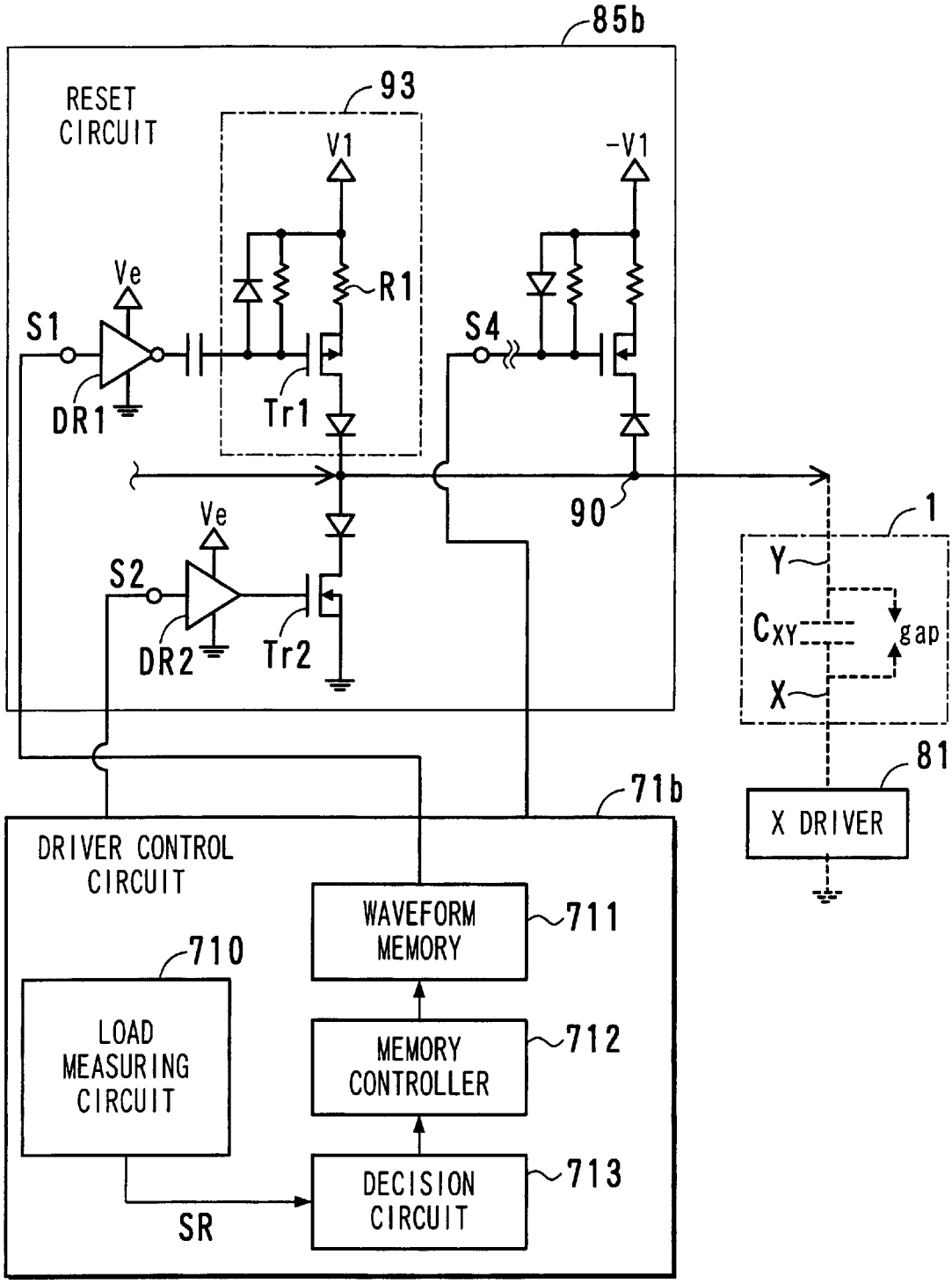
FIG. 8 is a schematic of the reset circuit and the driver control circuit according to the second embodiment.

FIG. 8 is a schematic view of the reset circuit and the driver control circuit according to the second embodiment.

A reset circuit 85*b* shown in FIG. 8 corresponds to a reset circuit 85 shown in FIG. 5 explained above from which the auxiliary charging circuit 95 is eliminated. The driver control circuit 71*b* includes a load measuring circuit 710 for measuring a display load (a ratio of lighted cells) in the previous subframe, a waveform memory 711 for memorizing plural kinds of gate signal waveforms, a memory controller 712 for controlling reading out the gate signal waveform, and a decision circuit 713 for deciding a quantity of the display load in accordance with a measurement signal SR from the load measuring circuit 710. One gate signal waveform is selected in accordance with an output of the decision circuit 713, and a waveform of the selected gate signal is adapted to the gate signal S1 for controlling on and off of the transistor Tr1.

Figure 9A:
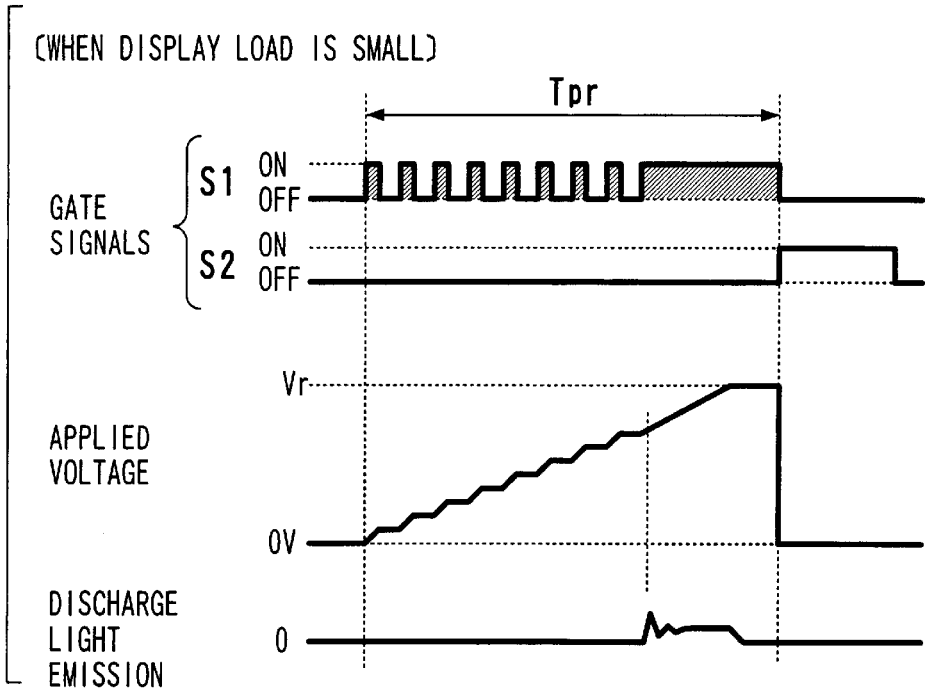
FIGS. 9A and 9B are diagrams of waveforms showing an example of a driving method according to the second embodiment.
Figure 9B:
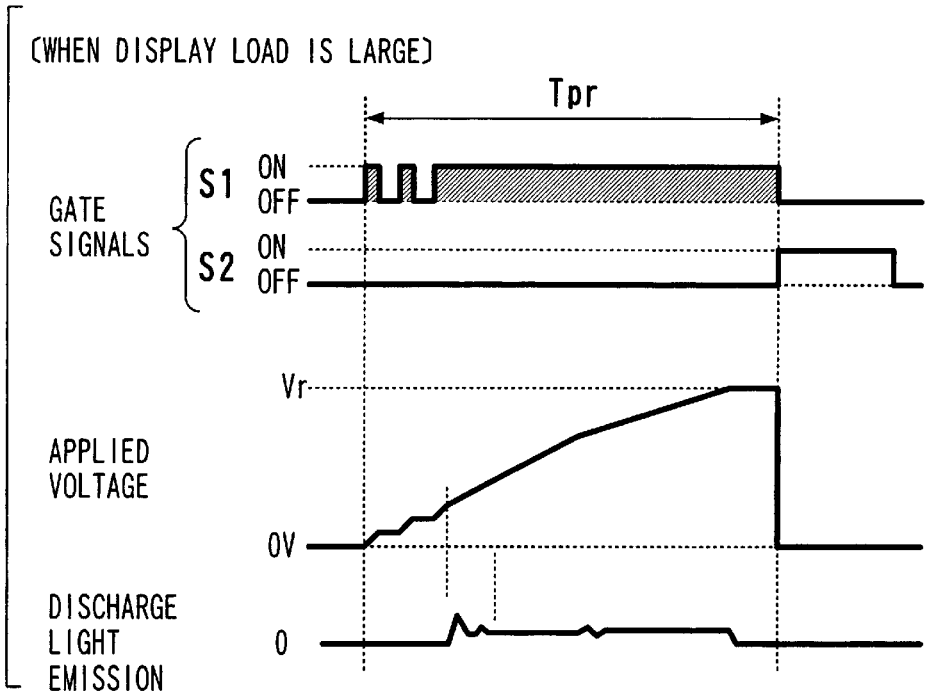

FIGS. 9A and 9B are diagrams of waveforms showing an example of a driving method according to the second embodiment.

When repeating on and off of the transistor Tr1, a waveform of the applied voltage looks like steps, as shown in FIGS. 9A and 9B. By setting on and off timings, a height and a width of the step can be controlled. For example, if the display load is small, the gradient of the ramp waveform can be prevented from being too large by reducing a pulse density (ratio of the on time in the period Tpr) of the gate signal S1 as shown in FIG. 9A. If the display load is large, a pulse density of the gate signal S1 is increased at relatively early timing in the period Tpr as shown in FIG. 9B, so that the delay of the voltage rise is avoided in a period of continuous discharge. In the example shown in FIGS. 9A and 9B, there are two kinds of gate signal waveforms. By increasing the kind of the gate signal waveforms memorized in the waveform memory 711, the transistor Tr1 can be controlled in detail responding to change of the display load, so that the initialization with a high reliability can be realized without affected by the display load.

Furthermore, in the charge control utilizing a microdischarge, a step waveform voltage in which the amplitude increases step by step is more preferable than a ramp waveform voltage in which the amplitude increases continuously, considering the fact that the discharge intensity in the continuous ramp waveform voltage increases along with the repeated microdischarge. The reason for this is considered a priming effect due to an accumulation of a space charge. When the discharge intensity increases, the variation width of the cell voltage is enlarged. Therefore, an error can be generated in the wall voltage at the end of the application. In addition, an undesired light emission can be generated. In contrast, the step waveform voltage can stabilize the intensity of the microdischarge by selecting the waveform.

Figure 10:
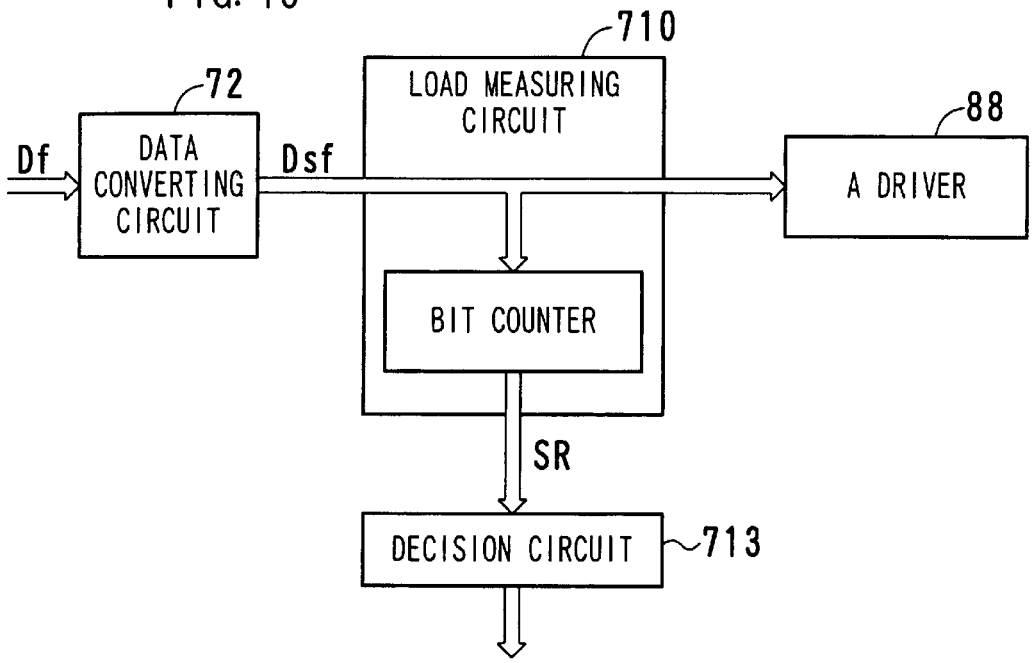
FIG. 10 is a diagram showing a first example of the load measuring circuit.
Figure 11:
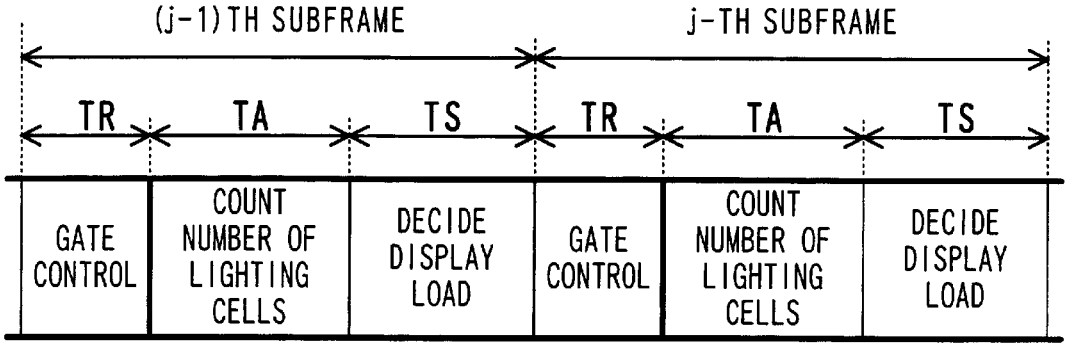
FIG. 11 is a timing chart showing an operation of the driver control circuit including the load measuring circuit of the first example.

FIG. 10 is a diagram showing a first example of the load measuring circuit. FIG. 11 is a timing chart showing an operation of the driver control circuit including the load measuring circuit of the first example.

As shown in FIG. 10, the load measuring circuit 710 includes a bit counter and counts the number of lighting cells by fetching the subframe data Dsf that are outputted by the data converting circuit 72. The decision circuit 713 decides the quantity of the display load by comparing the number of lighting cells indicated by the measurement signal SR with a predetermined threshold level. Adopting the configuration of the first example, the display load can be measured precisely.

As shown in FIG. 11, as a preparation for the gate control in the reset period TR of the j-th subframe, the driver control circuit 71*b* counts the number of lighting cells in the address period TA of the previous (j−1)th subframe, and decides the display load in the display period TS of the same (j−1)th subframe so as to select a gate signal waveform to be used for the gate control.

Figure 12:
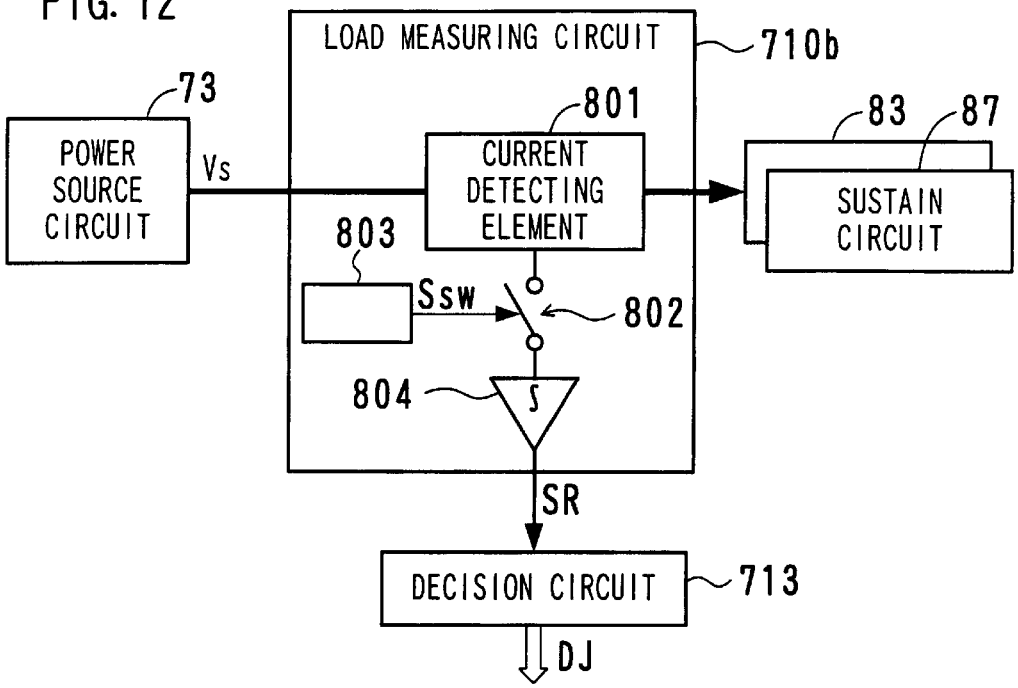
FIG. 12 is a diagram showing a second example of the load measuring circuit.
Figure 13:
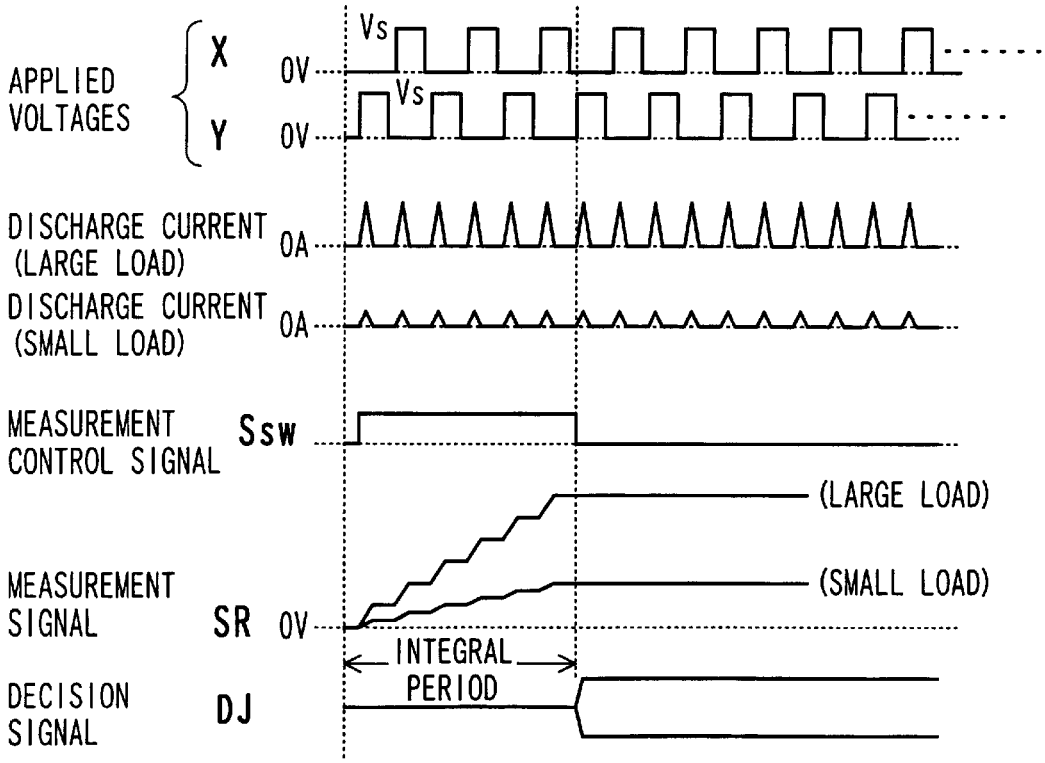
FIG. 13 is a diagram showing an operation of a second example of the load measuring circuit.
Figure 14:
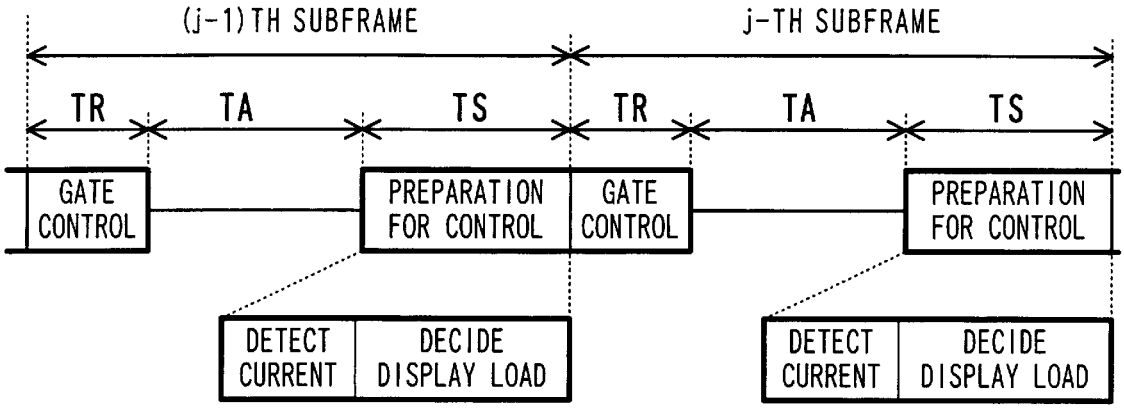
FIG. 14 is a diagram showing an operation timing of the driver control circuit including a load measuring circuit of the second example.

FIG. 12 is a diagram showing a second example of the load measuring circuit. FIG. 13 is a diagram showing an operation of a second example of the load measuring circuit. FIG. 14 is a diagram showing an operation timing of the driver control circuit including a load measuring circuit of the second example.

As shown in FIG. 12, a load measuring circuit 710*b* includes a current detecting element 801, a switching element 802, a switching controller 803, and a current integrator 804. The current detecting element 801 detects a current flowing from the power source circuit 73 to sustain circuits 83 and 87. A measurement control signal Ssw outputted by the switching controller 803 sets the switching element 802 in the closed state in an integral period, while a detected value of the current detecting element 801 is inputted in the current integrator 804. The current integrator 804 sends the measurement signal SR indicating an input accumulation (integral value) to the decision circuit 713. The decision circuit 713 outputs a decision signal DJ corresponding to a value of the measurement signal SR at the end of the integral period.

As shown in FIG. 14, as a preparation for the gate control in the reset period TR of the j-th subframe, the driver control circuit 71*b* detects the current in the display period TS of the previous (j−1)th subframe and decides the display load so as to select a gate signal waveform to be used for the gate control. The integral period is set at the front half portion of the display period TS.

Figure 15:
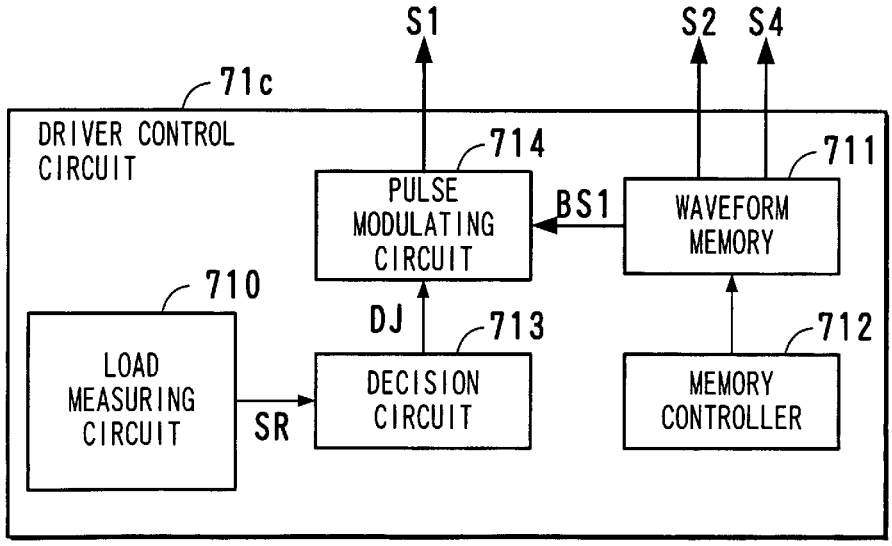
FIG. 15 is a diagram showing another configuration of the driver control circuit.

FIG. 15 is a diagram showing another configuration of the driver control circuit.

As shown in FIG. 15, a driver control circuit 71*c* includes a pulse modulating circuit 714 as means for switching the pulse density of the gate signal S1. The waveform memory 711 memorizes waveform data defining gate signals S2 and S4 and waveform data BS1 defining a timing of the period Tpr. The decision circuit 713 compares a value of the measurement signal SR from the load detecting circuit 710 with a predetermined threshold level so as to decide a quantity of the display load. A decision signal DJ indicating the result is given to the pulse modulating circuit 714. The pulse modulating circuit 714 modulates waveform data BS1 in accordance with the decision signal DJ and outputs the gate signal S1 made of the pulse train shown in FIG. 9. According to this configuration, memory contents of the waveform memory 711 can be the same as in the conventional method, so a waveform memory that is used in the conventional method can also be used for the method of the present invention.

In the examples explained above, the applied voltage is increased from zero. It is also possible to increase the applied voltage rapidly to a predetermined value that does not generate a discharge by applying a trapezoidal waveform voltage that is a ramp waveform voltage plus a rectangular waveform voltage to a cell in the period Tpr and then increase the applied voltage gradually. Thus, the reset period can be shortened by the rapid increasing portion.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A driving method of a plasma display panel, comprising:

in a bias period within a reset period, connecting a capacitance element, at opposite terminals thereof, to a pair of display electrodes to present substantially only a capacitive reactance in parallel with a capacitive load of respective discharge cells of the plasma display panel; and in the reset period, applying an increasing voltage to the pair of display electrodes by supplying an output current from a constant current circuit to the discharge cells, in succession for each of plural pairs of display electrodes and respective discharge cells to equalize charge in all discharge cells of the plasma display panel, and to distribute respective portions of the output current of the constant current circuit to the parallel-connected capacitance element and the discharge cells.

2. The driving method according to claim 1, wherein, in the bias period, the opposite terminals of the capacitance element are connected to the pair of the display electrodes, corresponding to the discharge cells intermittently.

3. The driving method according to claim 1, wherein the increasing voltage generates a micro-discharge in the respective discharge cells.

4. A driving method of a plasma display panel, comprising:

providing a reset period to equalize charge of all discharge cells prior to a display period to light respective discharge cells in accordance with a gradation; and supplying a current from a constant current circuit to one of the discharge cells in the reset period to apply an increasing voltage to a pair of display electrodes, wherein the supply of the current from the constant current circuit is performed intermittently in accordance with a quantity of a display load in the display period.

5. The driving method according to claim 4, further comprising:

controlling a rate of change of the increasing voltage by controlling a connection of the capacitance element to one constant current output.

6. A driving circuit applying an increasing voltage to a pair of display electrodes, in succession for each of plural pairs of display electrodes and respective discharge cells in a reset period to equalize charge of all discharge cells of a plasma display panel, when displaying by the plasma display panel including plural discharge cells, each of which is lightable by a discharge between a respective pair of display electrodes, the driving circuit comprising:

a constant current circuit including a current limiting resistor and a semiconductor switching device, supplying a current from a power source through the current limiting resistor to one of the pair of display electrodes; and an auxiliary charging circuit including a capacitance element and a switching device making and breaking a conductive path between the capacitance element and the constant current circuit.

7. The driving circuit according to claim 6, wherein a rate of change of the increasing voltage is controlled by making and breaking a conductive path between a connection of the capacitance element and an output of the constant current circuit.

8. A driving circuit applying an increasing voltage to a pair of display electrodes, in succession for each of plural pairs of display electrodes and respective discharge cells in a reset period to equalize charge of all discharge cells of a plasma display panel provided prior to a display period to light the respective discharge cells in accordance with a gradation when displaying by the plasma display panel including plural discharge cells, each of which is lightable by a discharge between a respective pair of display electrodes, the driving circuit comprising:

a constant current circuit including a current limiting resistor and a semiconductor switching device, supplying a current from a power source through the current limiting resistor to one of the pair of display electrodes; and a control circuit switching the semiconductor switching device in accordance with a quantity of a display load in the display period.

9. The driving circuit according to claim 8, wherein the control circuit includes a memory to memorize plural types of switching waveforms defining switching timing of the semiconductor switching device and a load measuring circuit measuring the display load quantity, and the driving circuit performs the switching of the semiconductor switching device by applying one switching waveform in accordance with the measured display load quantity.

10. The driving circuit according to claim 9, wherein the load measuring circuit is a counting circuit measuring a number of the discharge cells to be lit in the display period as the display load quantity.

11. The driving circuit according to claim 9, wherein the load measuring circuit measures a discharge current in the display period as the display load quantity.

12. The driving circuit according to claim 8, wherein the control circuit includes a pulse modulating circuit modulating a basic pulse so as to output a pulse train defining a switching timing of the semiconductor switching device by modulating and a load measuring circuit measuring the display load quantity, and the driving circuit performs the switching of the semiconductor switching device by applying the pulse train modulated in accordance with the measured display load quantity.

13. A display device, comprising:

an AC type plasma display panel including plural discharge cells, each of which is lightable by a discharge between a respective pair of display electrodes;

a driving circuit applying an increasing voltage to the pair of display electrodes, in succession for each of plural pairs of display electrodes and respective discharge cells in a reset period to equalize charge of all discharge cells of the AC type plasma display panel provided prior to a display period to light the respective discharge cells in accordance with a gradation; and the driving circuit including a constant current circuit including a current limiting resistor and a semiconductor switching device, supplying a current from a power source through the current limiting resistor to one of the pair of display electrodes, and a control circuit switching the semiconductor switching device in accordance with a quantity of a display load in the display period.

14. A driving method of a plasma display panel, comprising:

in a reset period, applying a ramp voltage to a pair of display electrodes to generate a micro-discharge in discharge cells by supplying an output current from a constant current circuit to the discharge cells, in succession for each of plural pairs of display electrodes and respective discharge cells, wherein during bias periods within the reset period, selectively connecting in parallel and disconnecting a capacitance element and the discharge cells to distribute the output current of a constant magnitude, when selectively connected, from the constant current circuit to the parallel-connected capacitance element and discharge cells.

15. A driving circuit for a plasma display panel including a plurality of discharge cells, each discharge cell having a pair of display electrodes, wherein a ramp voltage is applied to the pair of display electrodes for each pairs of display electrodes in a reset period to equalize charge in all of the discharge cells of the plasma display panel, one or more discharge cells being lit in a display period when displaying by the plasma display panel in accordance with a gradation, each of the one or more discharge cells being lit by a discharge between a respective pair of display electrodes, comprising:

a constant current circuit including a current limiting resistor and a switching device to supply a current through the current limiting resistor to one of the pair of display electrodes; and a control circuit switching the switching device in accordance with a quantity of a display load in the display period.

16. A driving method of a plasma display panel, comprising;

in a reset period to equalize charge in all discharge cells, applying an increasing voltage to a pair of display electrodes, successively for each of plural pairs of display electrodes, to successively supply a constant current to respective discharge cells;

in a bias period within the reset period, connecting terminals of a capacitance element, presenting substantially only a capacitive reactance, in parallel with the pair of display electrodes to apply the increasing voltage thereto; and distributing an output current of the constant current circuit to the parallel-connected capacitance element and the display electrodes of the plasma display panel.

17. A driving method of a plasma display panel, comprising:

providing a capacitance element as a capacitive load in parallel with, and different from, the capacitive load of discharge cells of the plasma display panel;

providing a reset period to equalize charges of the discharge cells; and in the reset period, applying an increasing voltage to a pair of display electrodes by supplying an output current from a constant current circuit to the discharge cells and the capacitive element, wherein a portion of the output current is supplied to the discharge cells and a remaining portion of the output current is supplied to the capacitance element.

18. The driving method according to claim 17, wherein, in the bias period, the opposite terminals of the capacitance element are connected to the pair of the display electrodes, corresponding to the discharge cell, intermittently.

19. The driving method according to claim 17, wherein the increasing voltage generates a micro-discharge in the discharge cells.

20. A driving method of a plasma display panel, comprising:

providing a reset period prior to a display period in which discharge cells making up a screen are lit depending on each gradation of each discharge cell;

providing a capacitance element as a capacitive load different from the discharge cells;

applying a ramp voltage to the cells to generate a micro-discharge in the discharge cells by supplying an output current from a constant current circuit to the discharge cells in the reset period, wherein:

a portion of the output current of the constant current circuit is supplied to the discharge cells and a remaining portion of the output current is supplied to the capacitance element in the reset period when the increasing voltage is applied.

21. The driving method according to claim 20, wherein, in the bias period, the opposite terminals of the capacitance element are connected to the pair of the display electrodes, corresponding to the discharge cell, intermittently.

22. The driving method according to claim 20, wherein the increasing voltage generates a micro-discharge in the discharge cells.

* * * * *